US006013040A

United States Patent [19]

Morgenstern et al.

[11] Patent Number: 6,013,040

[45] Date of Patent: Jan. 11, 2000

[54] POWER ACTUATED LUMBOSACRAL BACKREST

[75] Inventors: Robin Morgenstern; George D. Wolf, both of Chicago, Ill.

[73] Assignee: Kingstar International America, Chicago, Ill.

[21] Appl. No.: 08/939,473

[22] Filed: Sep. 22, 1997

Related U.S. Application Data

[60] Provisional application No. 60/025,757, Sep. 23, 1996.

[51] Int. Cl.[7] ..... A61H 7/00

[52] U.S. Cl. ..... 601/103; 601/101; 601/98; 297/284.4; 297/284.1

[58] Field of Search ..... 297/284.1, 284.4; 601/97, 98, 99, 100, 101, 102, 103, 84, 134

[56] References Cited

U.S. PATENT DOCUMENTS

| | | | |
|---|---|---|---|
| 3,656,190 | 4/1972 | Regan et al. | 601/103 |
| 3,890,000 | 6/1975 | Easley | 297/284 |
| 4,085,738 | 4/1978 | Kodera | 601/103 |
| 4,170,989 | 10/1979 | Miniere | 601/102 |
| 4,239,282 | 12/1980 | White | 297/284 |
| 4,412,534 | 11/1983 | Hamabe et al. | 601/102 |
| 5,179,940 | 1/1993 | Barreiro | 128/33 |
| 5,330,416 | 7/1994 | Masuda et al. | 601/52 |
| 5,352,186 | 10/1994 | Yamasaki et al. | 601/99 |
| 5,385,531 | 1/1995 | Jover | 601/99 |
| 5,460,598 | 10/1995 | Yamasaki et al. | 601/99 |
| 5,462,516 | 10/1995 | Anderson | 601/99 |
| 5,464,382 | 11/1995 | Wang | 601/99 |

*Primary Examiner*—Jerome W. Donnelly
*Assistant Examiner*—Benjamin Koo
*Attorney, Agent, or Firm*—Michael Best & Friedrich

[57] ABSTRACT

A power actuated mechanical backrest apparatus is disclosed. This device is provided to cooperatively interact with the musculature of the human back for the purpose of providing massage action. The device consists of a rigid frame including a movable spindle. The device functions using a movable spindle and a variety of gears to cause various plungers to ride against undulating forms causing the plungers to undulate against the user's back and thereby provide a mechanical massage action. The backrest is overlaid with a cushion material that may be provided with a heating member. The device is small, portable and lightweight.

10 Claims, 9 Drawing Sheets

POWER ACTUATED LUMBOSACRAL BACKREST

This application is a continuation-in-part of U.S. Provisional Patent Application No. 60/025,757 entitled Power Actuater Lumbosacral Backrest, filed Sep. 23, 1996.

The present invention relates to portable backrests of the power actuated type for use with chairs, beds and other furniture, and vehicle seats and wheelchairs. The invention relates more specifically to portable backrests of this nature having novel power driven and manual control means for adjusting the support contour to accommodate individual users with backs of various physical proportions.

The invention represents an improvement over those devices disclosed and claimed in our prior U.S. Pat. Nos. 4,541,670, 4,722,569, and 4,915,448.

BACKGROUND OF THE INVENTION

It is well known that back pain and back disorders afflict a major segment of the population. There are numerous causes for these problems such as bad posture, poor sitting habits, or poor physical condition, resulting in distortion of the natural elongated S-shape of the spinal column. A well constructed and properly adjusted backrest tends to restore the spinal S-curve to its proper configuration, thus relieving or avoiding the uneven pressures on discs and vertebrae which cause undue pain and fatigue.

In addition to the prior Morgenstern et al. patents mentioned above, the following prior art patents were noted as pertinent to the backrest art:

| | |
|---|---|
| 2,049,550 | Can Dresser et al |
| 2,756,809 | Endresen |
| 2,843,195 | Barvaeus |
| 2,894,565 | Connor |
| 3,196,868 | Johnston |
| 3,250,569 | Gaffney |
| 3,642,319 | Berchicci |
| 3,663,055 | Gale |
| 3,762,769 | Poschl |
| 3,890,000 | Easley |
| 3,990,742 | Glass et al. |
| 4,239,282 | White |
| 4,350,338 | Weiner |
| 4,465,317 | Schwartz |
| France 1,182,558 | Fader |

SUMMARY OF THE INVENTION

One object of the present invention is to provide a lumbosacral backrest adjustable by power means under control of the user to establish a transverse plane of rigidity at a level which affords comfortable support for the user's back.

Another object is to provide a backrest of the character set forth above having user actuated power means to reciprocate the transverse plane or rigidity vertically for purposes of gentle back massage.

Yet another object is to provide a backrest as set forth wherein a user can actuate an integrally formed heating element which provides heating action.

A further object is to provide a reliable backrest of the above type at moderate cost and capable of operating reliably.

The foregoing is accomplished by use of a precisely guided regulator spindle operated by means of a direct power drive which is reversible and under control of the user.

BRIEF DESCRIPTION OF THE DRAWINGS

FIG. 6 is a front elevational view of the backrest of the invention further including a zippered cover with the power connector for the heating element extending therefrom.

Figure 1:
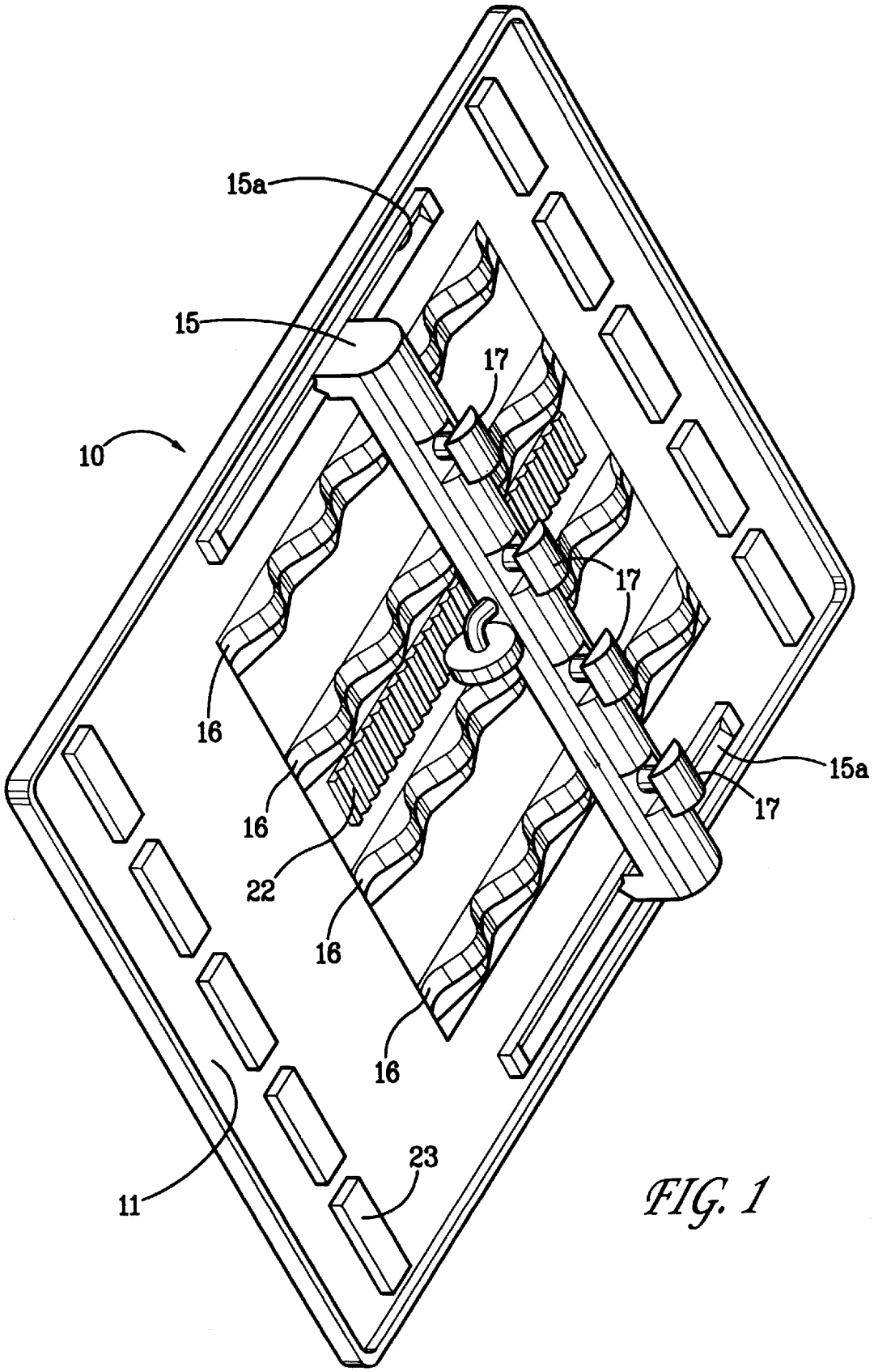
FIG. 1 is a front elevational view of the interior of a power operated backrest embodying the present invention.

While the present invention is susceptible of various modifications and alternative constructions, there is no intention to limit the invention to the specific forms illustrated and described herein. On the contrary, the intention is to cover all modifications and alternative constructions falling within the spirit and scope of the invention as set forth in the appended claims.

DETAILED DESCRIPTION OF THE INVENTION

The present invention resides in certain improvements over the power driven backrests disclosed and claimed in our prior U.S. Pat. No. 4,541,670 issued Sep. 17, 1985, U.S. Pat. No. 4,722,569; issued Feb. 2, 1988; and, U.S. Pat. No. 4,915,448, issued Jul. 11, 1990. Referring more specifically to FIGS. 1 through 4, there is shown a power actuated backrest 10 built upon a foundation frame 11 of durable plastic or metallic material. The frame 11 is slightly wider at the top than at the bottom.

The backrest 10 has a transverse spindle 15 which houses a reinforcing shaft (not shown) traveling within a pair of slots 15*a* at each end of the shaft. The spindle 15 includes a series of undulating forms 16 which engage overlying plungers 17 made of steel or plastic which follow against the faces of the undulating forms 16.

Figure 3:
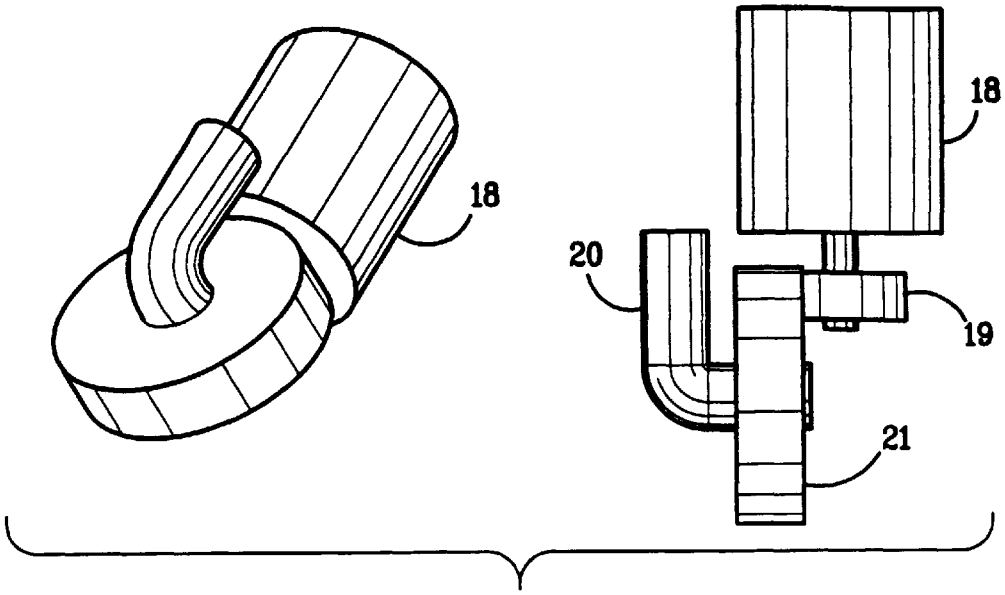
FIG. 3 is an elevational and side view of a motor and drive yoke of the invention.
Figure 4:
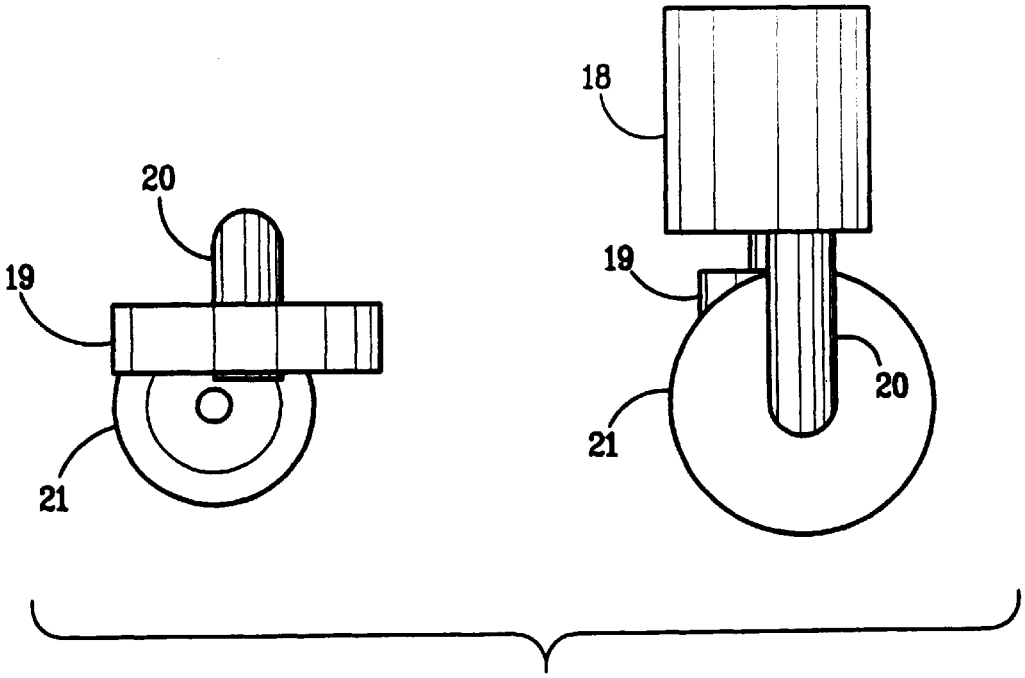
FIG. 4 is a front and back view of the drive yoke of FIG. 3.

Power for actuating the spindle 15 is derived from a vertically oriented electric motor 18 attached to the spindle 15, (FIG. 3). The motor may include a small reduction gear 19 which drives a vertically extending right angled shaft 20. Power is transmitted from the shaft 20 to the spindle 15 by means of a toothed wheel 21 (FIGS. 3 and 4). The motor may be controlled by a switch (not shown) operated by the user. Additionally, the motor can be of a conventional d.c. brushless design.

The spindle drive block 22 is a longitudinal gear platform upon which toothed wheel 21 travels when the motor 18 is actuated. When the motor 18 is actuated, toothed wheel 21 travels back and forth on drive block 22, with the plungers 17 riding on undulating forms 16, creating an oscillating massage action.

Figure 2:
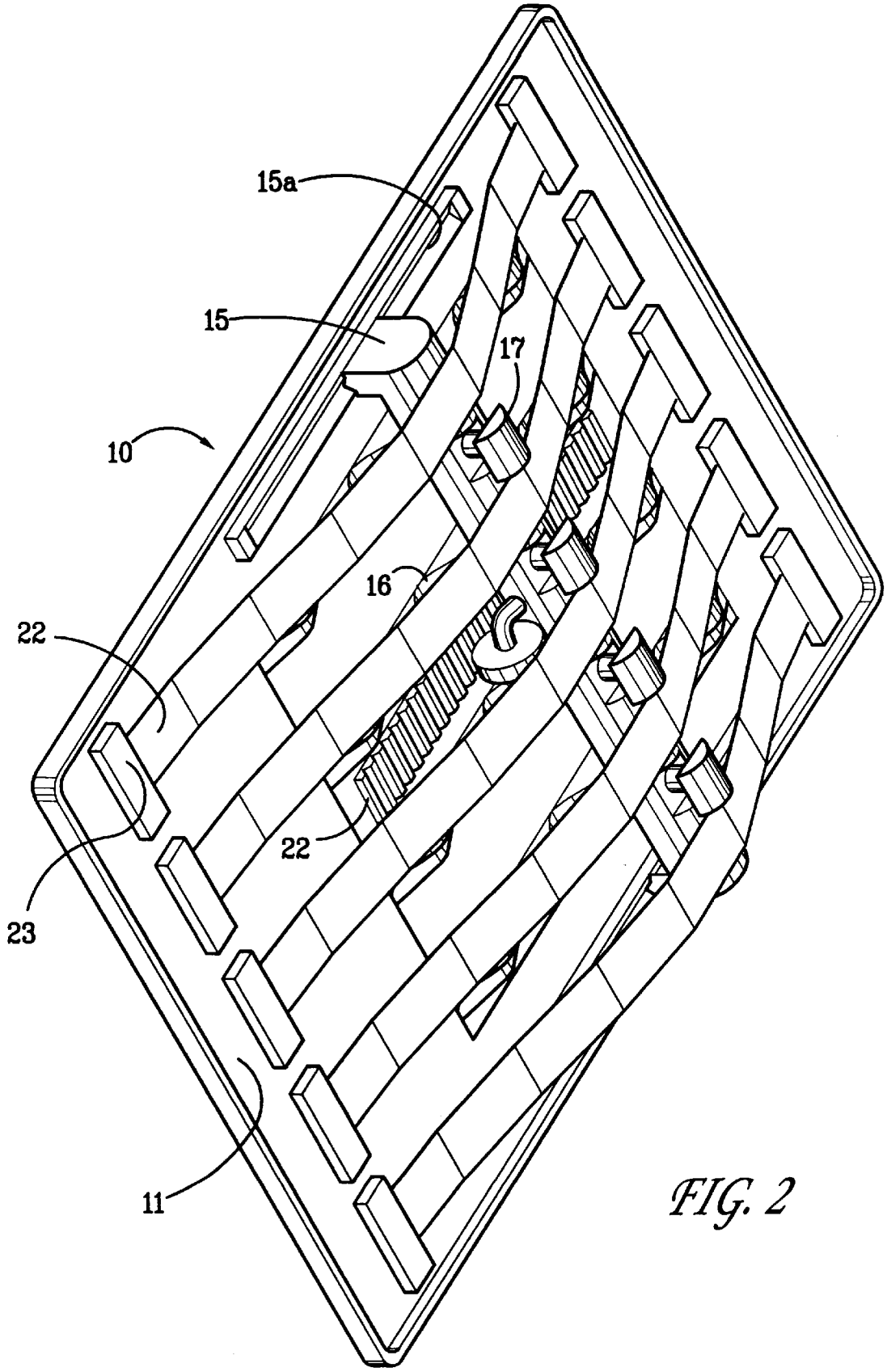
FIG. 2 is a front elevational view of the interior of a power operated backrest of FIG. 1 with flexible bands.

FIG. 2 shows the addition of back support bands 22, inserted in cutouts 23 formed in the foundation 11.

Figure 5:
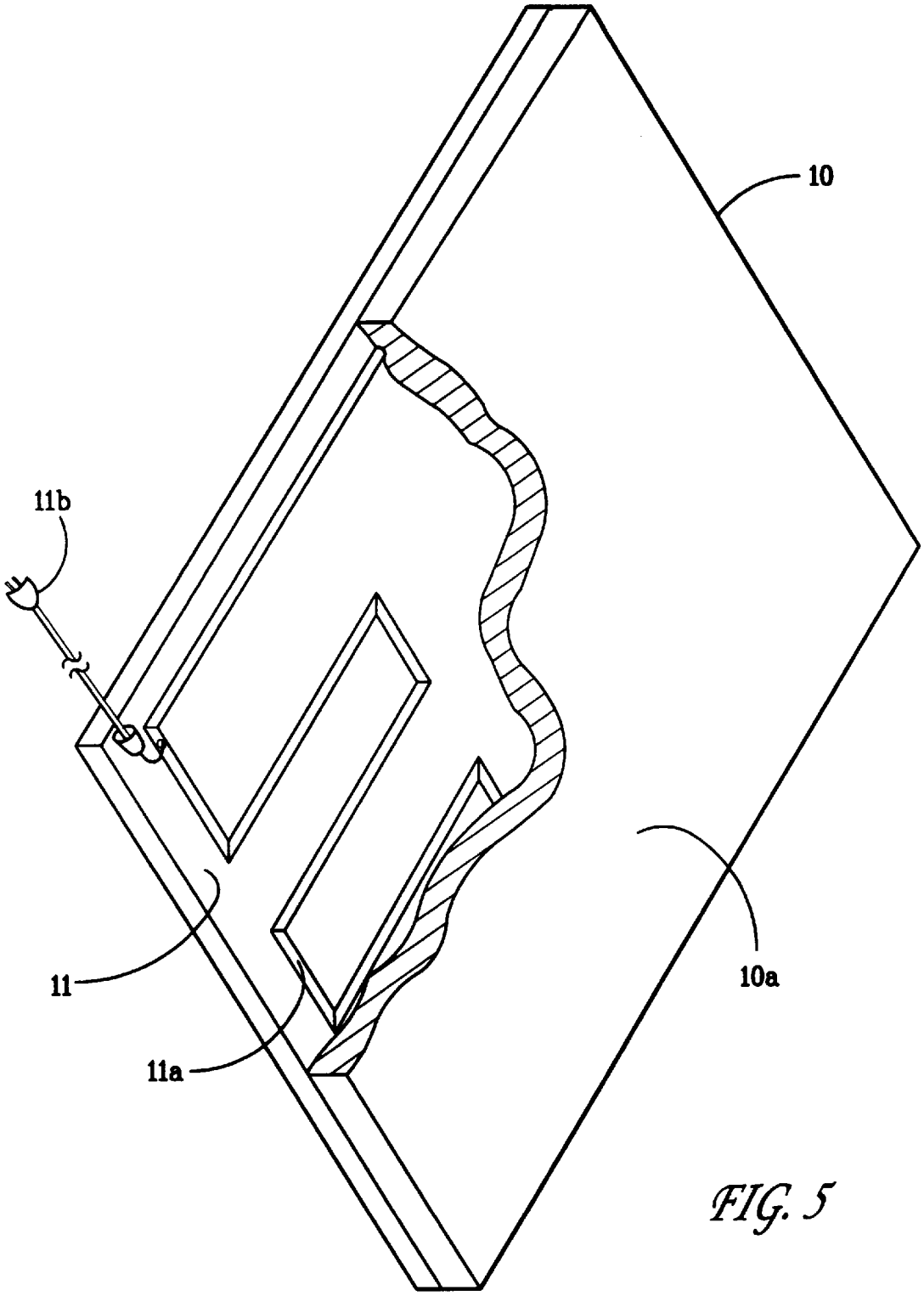
FIG. 5 is a front elevational view of the backrest of FIG. 1 with optional heat attachment.
Figure 6:
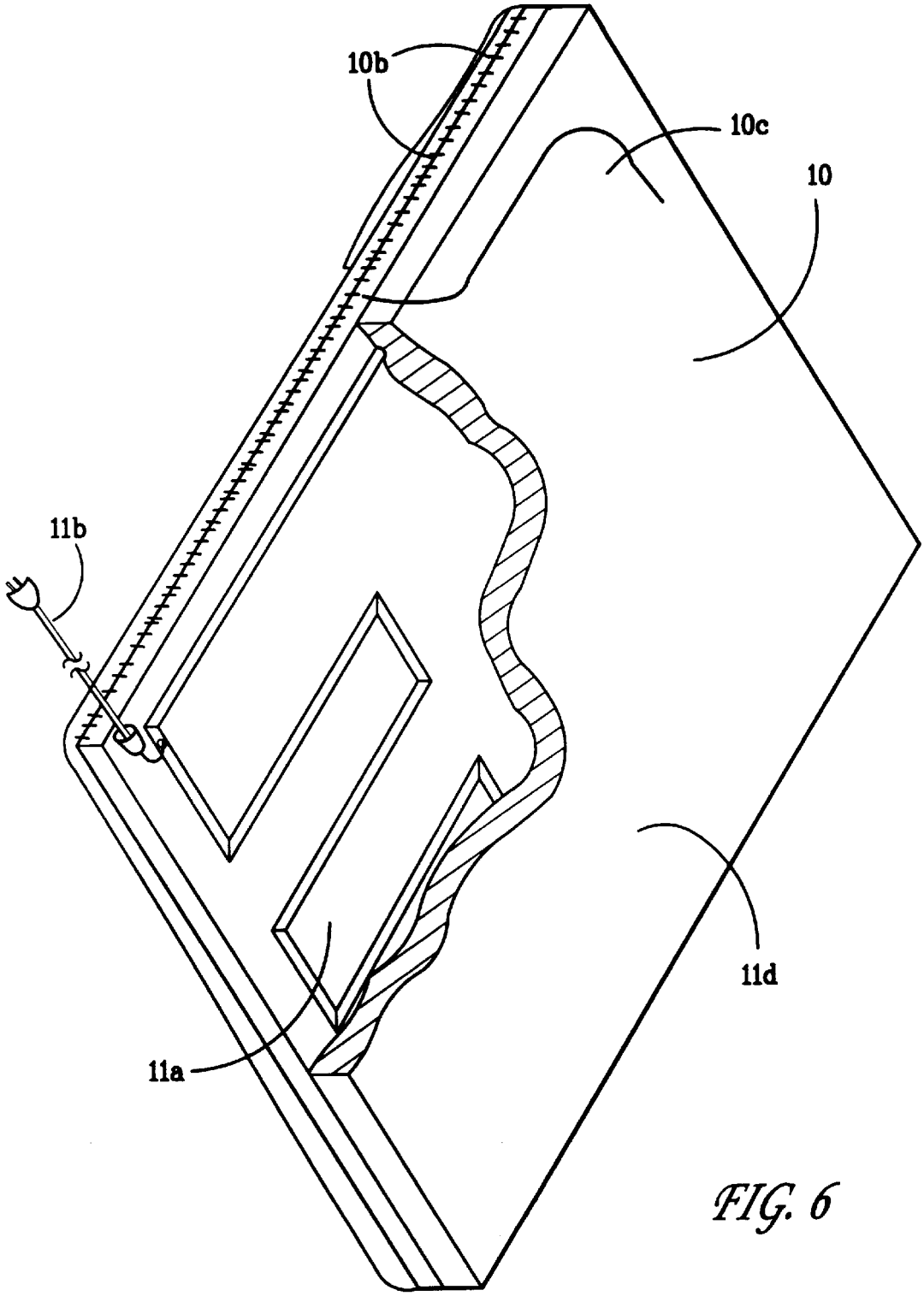
FIG. 6 is a perspective view of the heating element in conjunction with the backrest of FIG. 1, and showing the cover.

Turning now to FIGS. 5, and 6 there is shown the back rest 10 with foundation frame 11, overlaid with cushion material 11*d*, with an electrical heating element 11*a* within a layer of cushion material. FIGS. 5 and 6 show the heating element 11*a* disposed within the cushion material 11*b*. The heating element 11*a* can be formed from any of numerous conventional materials, such as metallized tape, copper coils, etc. A connector plug 11*b* is electrically connected to the heating element 11*a* for ready attachment to an appropriate power source (not shown). FIGS. 5 and 6 also show a configuration for a cover 10 with a zipper 10*b* for closure of the cover 10.

It is envisioned that the present invention can be utilized with any power source with use of an appropriate connection and power supply (not shown) such as in an automobile, or in the home.

Figure 7:
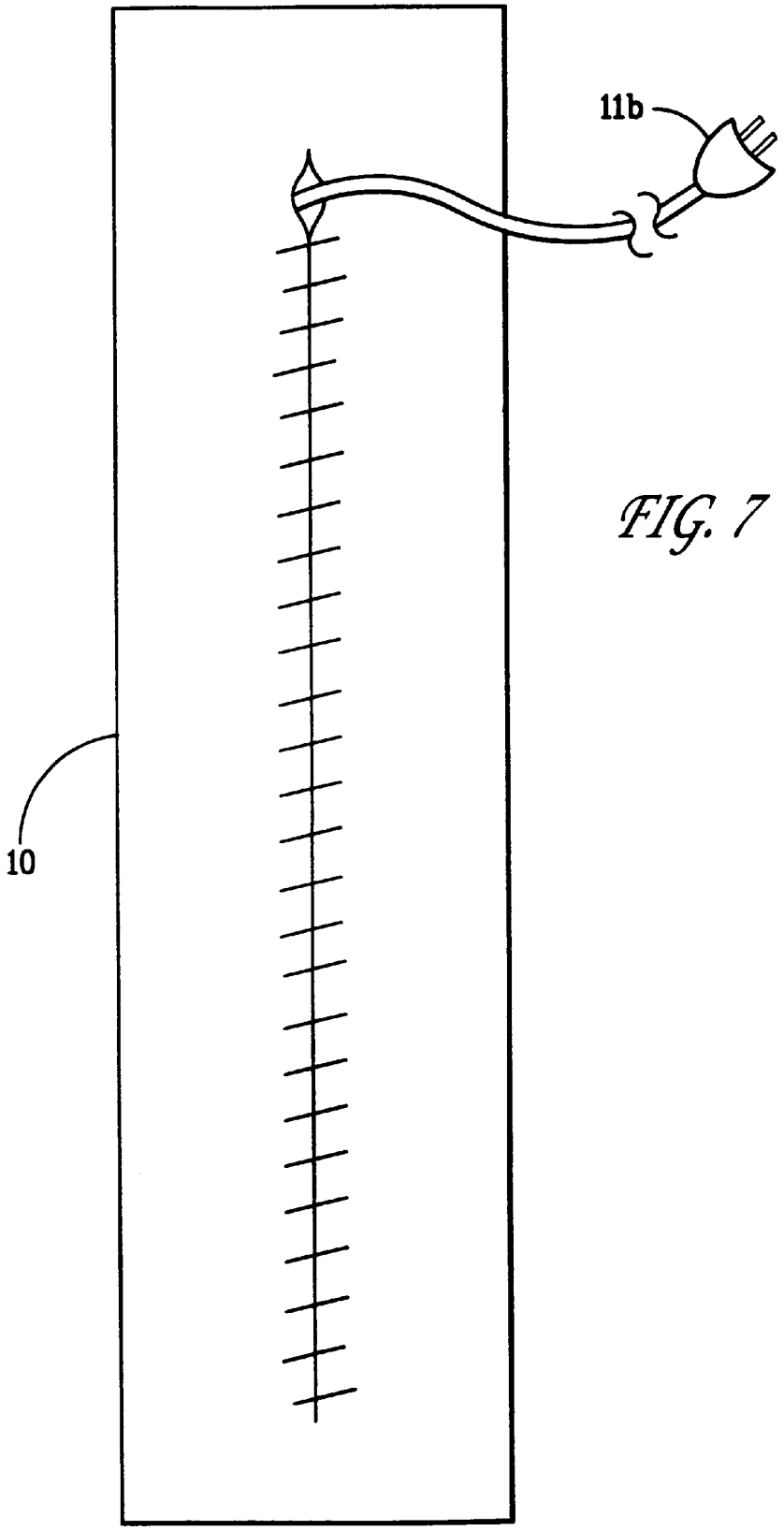
FIG. 7 is a side view of the power operated backrest with heat element.

As shown in FIG. 6, the backrest 10 of the invention, further includes a zippered cover 10*c* having a zipper 10*b* around the periphery of, and enclosing therein, the foundation 11 and cushion material. FIG. 7 shows the backrest 10 with zipper 10*b* closed such that the connector plug 11*b* extends therefrom.

Figure 8:
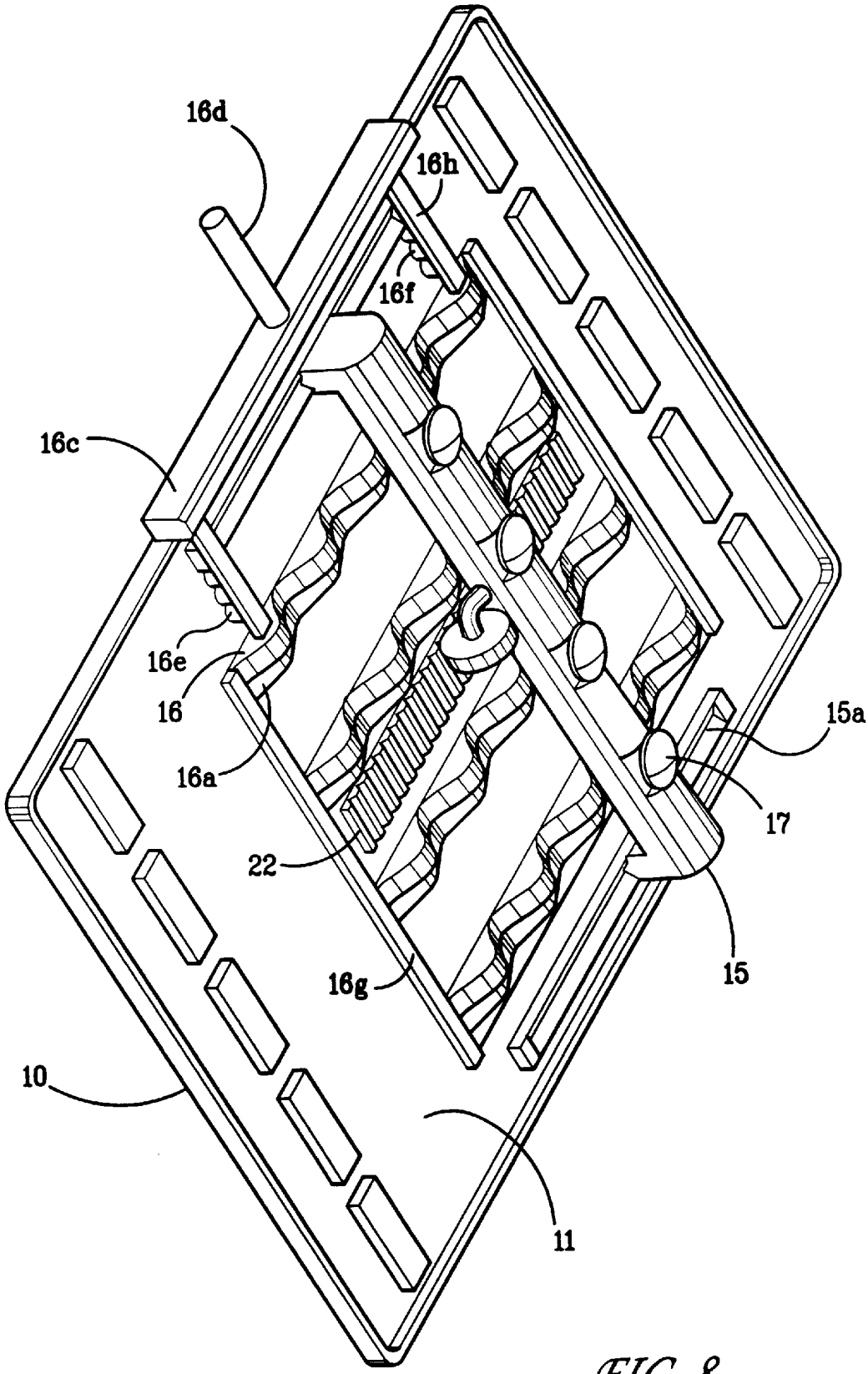
FIG. 8 is a front elevational view of another embodiment of the present invention wherein means for determining the degree of massage action, and means to select such degree of action are shown.
Figure 9:
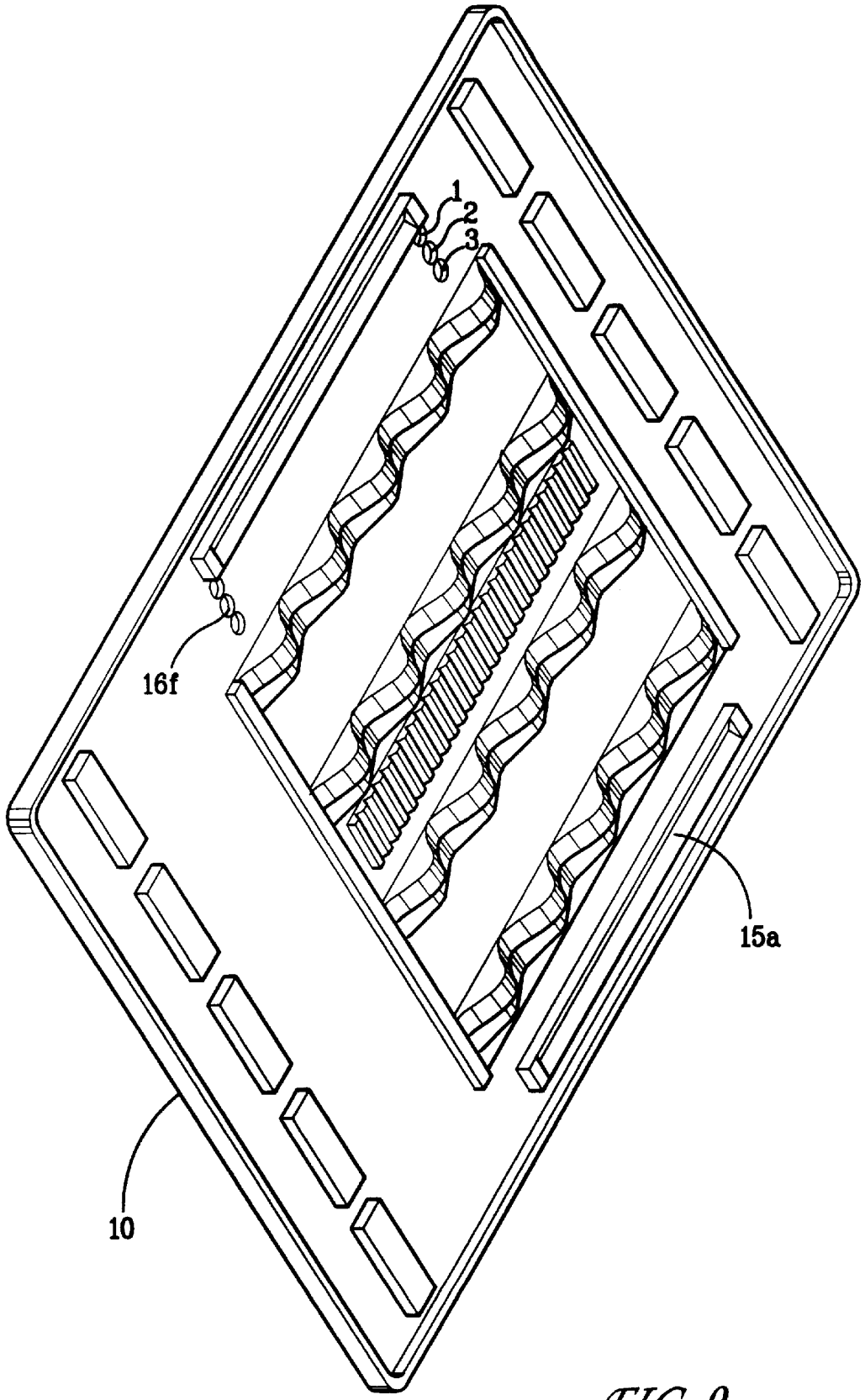
FIG. 9 is a front elevational view of the embodiment of FIG. 8 showing the foundation and undulating forms.

Another embodiment of the invention is shown in FIGS. 8 and 9. The foundation 10 can further include at least one additional set of undulating forms 16*a*, wherein a different wave period can be utilized, for a differing massage action. A user can select either undulating forms 16 or 16 a by utilizing the C-bracket 16*c* having a handle 16*d* that protrudes from the backrest 10.

The undulating forms 16, 16*a* are made to be carried together laterally to the spindle 15 within a track 16*g* with extending arms 16*h* of the C-bracket 16*c* attached to one set of undulating forms 16 such that lateral movement of the C-bracket 16*c* urges the undulating forms 16 and 16*a* laterally within the track of 16*g*. The extending arms 16*h* carry a protrusion 16*e* formed thereon that nates with a series of holes 16*f* (FIG. 9) formed in the foundation 11. By moving the C-bracket 16*d* laterally, any of three steps of massage action can be selected.

Step three (FIG. 9) moves the undulating form out from under plunger 17, stopping the massage undulating action. Step two selects the action of the undulating form 16*a*, while step one selects the massage action of undulating form 16.

Figure 10:
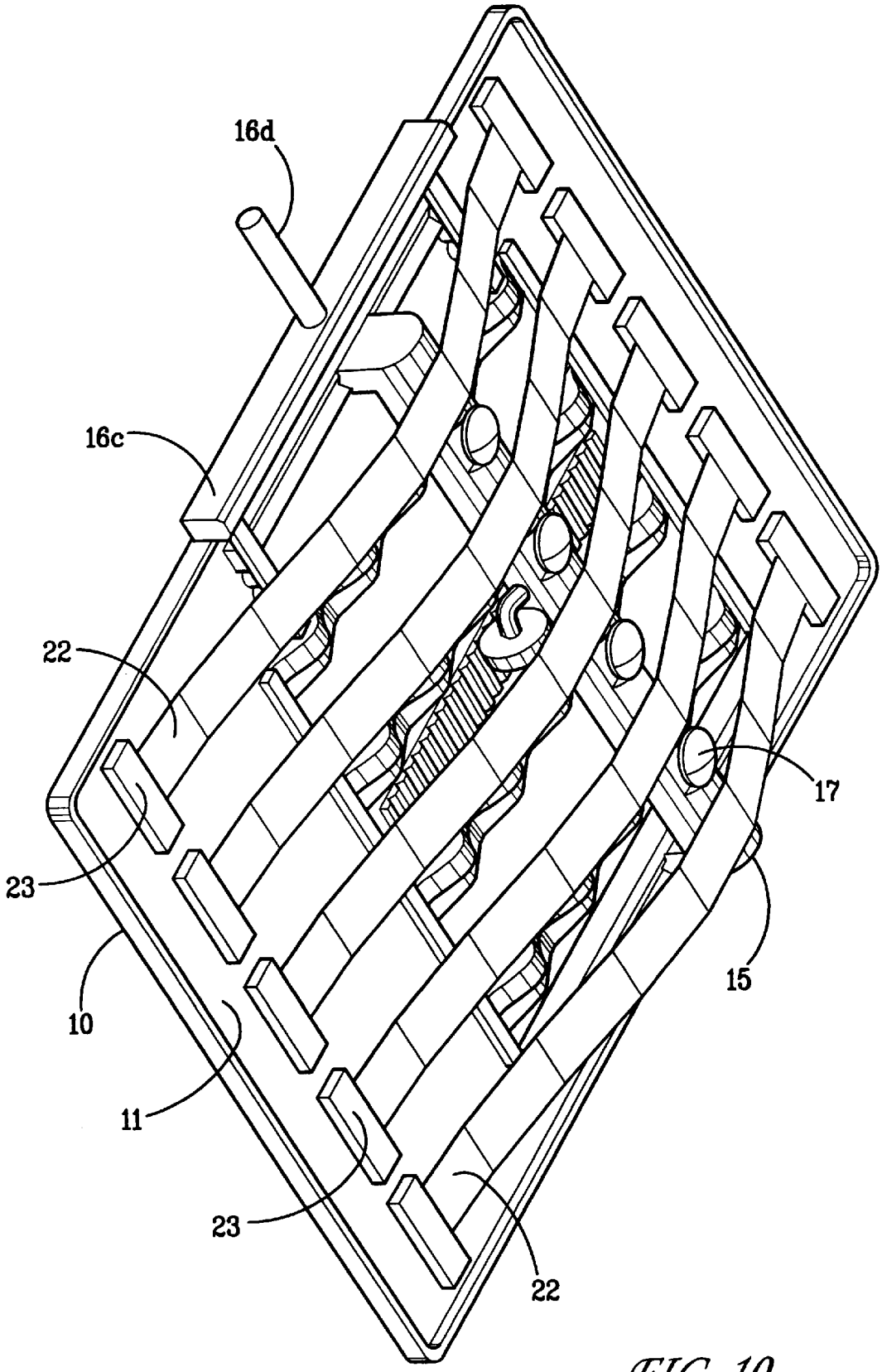
FIG. 10 is a front elevational view of the invention of FIG. 8 showing flexible bands thereover.

FIG. 10 shows the alternative embodiment hereinbefore described with the addition of back support bands 22, inserted in cutouts 23 formed in the foundation 11.

We claim as our invention:

1. A power driven lumbosacral backrest controlled by the user and comprising, in combination:

(a) A rigid foundation frame having a top, bottom and first and second edges;

(b) a pair of slots disposed along said first and second edges of said foundation frame;

(c) a spindle including a shaft with end guides at each end of said shaft, said spindle and shaft disposed transversely of said foundation frame, said end guides engaging said first and second slots respectively;

(d) a motor and reduction gear located on said spindle, said motor and reduction gear connected to a toothed wheel via an extending right angled shaft;

(e) a series of undulating forms formed parallel with said first and second slots, over which travel respective plungers, said plungers carried by said spindle;

(f) a spindle drive block formed adjacent to one of said undulating forms such that when said motor is actuated, said toothed wheel travels back and forth across said drive block, whereby said plungers follow said undulating forms via said spindle traveling in said slots, creating a massage action.

2. The power drive lumbosacral backrest of claim 1, further comprising back support bands extending between said slots at first and second ends of said frame, said bands overlaying said spindle.

3. The power driven lumbosacral backrest of claim 1, wherein said motor comprises a d.c. brushless motor.

4. The power driven lumbosacral backrest of claim 1 further comprising a heating element attached to said foundation frame.

5. The power driven backrest of claim 4 further comprising means for connecting said heating element to a power source determined by a user.

6. The power driven lumbosacral backrest of claim 1 further comprising a cushion material surrounding said backrest and arranged facing the undulating forms further including a heating element located within said cushion material.

7. The power driven lumbosacral backrest of claim 6 further comprising a zippered cover enclosing said cushion material with said foundation frame sandwiched there between.

8. A power driven lumbosacral backrest controlled by a user and comprising in combination:

(a) a foundation frame having a top, bottom and sides consisting of first and second edges;

(b) a pair of slots disposed along said first and second edges of said foundation frame;

(c) a series of apertures formed in said frame along one of said first and second edges thereof;

(d) a spindle disposed transversely of said foundation by frame having a pair of end guides connected by a shaft, said guides engaging said first and second slots respectively;

(e) a C-bracket having a handle extending from one end thereof, and first and second arms extending from the other end thereof, each of said arms having at least one protrusion formed on a face thereof;

(f) a motor and reduction gear located on said spindle and converted to a toothed wheel via an extending right-angled shaft;

(g) a series of first and second undulating forms formed parallel with said slots, over which travel respective plungers carried by said spindle, said first and second undulating forms laterally traveling in top and bottom tracks formed in said foundation;

(h) a spindle drive block formed adjacent to one of said undulating forms such that when said motor is actuated, said toothed wheel travels back and forth across said drive block, whereby said plungers follows said undulating forms via said spindle traveling in said slots, creating a massage action.

9. The power driven lumbosacral backrest of claim 8, wherein said C-bracket is capable of being moved laterally with respect to said foundation frame to urge said first and second undulating forms laterally with respect to said foundation frame in and out of engagement with said plungers, and said protrusion formed on said extending arms mate with an appropriate aperture formed in said foundation.

10. The power drive lumbosacral backrest of claim 9, wherein said first and second undulating forms each provide different degrees of massage action.

* * * * *